US009447368B1

(12) United States Patent
Koo et al.

(10) Patent No.: US 9,447,368 B1
(45) Date of Patent: Sep. 20, 2016

(54) DETERGENT COMPOSITION WITH LOW FOAM AND HIGH NICKEL SOLUBILITY

(71) Applicants: WD Media, LLC, San Jose, CA (US); MIPOX CORPORATION, Tokyo (JP)

(72) Inventors: Soh Kian Koo, Penang (MY); Kok Kin Yap, Penang (MY); Kamaruddin Ayob, Kulim (MY); Lau Meng Kun, Penang (MY)

(73) Assignees: WD MEDIA, LLC, San Jose, CA (US); MIPOX CORPORATION, Tokyo (JP)

( * ) Notice: Subject to any disclaimer, the term of this patent is extended or adjusted under 35 U.S.C. 154(b) by 0 days.

(21) Appl. No.: 14/554,415

(22) Filed: Nov. 26, 2014

Related U.S. Application Data

(60) Provisional application No. 61/941,295, filed on Feb. 18, 2014.

(51) Int. Cl.

| | |
|---|---|
| ***C11D 11/00*** | (2006.01) |
| ***C11D 7/26*** | (2006.01) |
| ***C11D 7/32*** | (2006.01) |
| ***C11D 7/02*** | (2006.01) |
| ***C11D 7/36*** | (2006.01) |

(52) U.S. Cl.
CPC ..... *C11D 11/0047* (2013.01); *C11D 7/02* (2013.01); *C11D 7/263* (2013.01); *C11D 7/265* (2013.01); *C11D 7/3209* (2013.01); *C11D 7/36* (2013.01)

(58) Field of Classification Search
CPC ..... C11D 11/0047
USPC ..... 510/165
See application file for complete search history.

(56) References Cited

U.S. PATENT DOCUMENTS

| | | | | |
|---|---|---|---|---|
| 6,013,161 | A | 1/2000 | Chen et al. | |
| 6,063,248 | A | 5/2000 | Bourez et al. | |
| 6,068,891 | A | 5/2000 | O'Dell et al. | |
| 6,086,730 | A | 7/2000 | Liu et al. | |
| 6,099,981 | A | 8/2000 | Nishimori | |
| 6,103,404 | A | 8/2000 | Ross et al. | |
| 6,117,499 | A | 9/2000 | Wong et al. | |
| 6,136,403 | A | 10/2000 | Prabhakara et al. | |
| 6,143,375 | A | 11/2000 | Ross et al. | |
| 6,145,849 | A | 11/2000 | Bae et al. | |
| 6,146,737 | A | 11/2000 | Malhotra et al. | |
| 6,149,696 | A | 11/2000 | Jia | |
| 6,150,015 | A | 11/2000 | Bertero et al. | |
| 6,156,404 | A | 12/2000 | Ross et al. | |
| 6,159,076 | A | 12/2000 | Sun et al. | |
| 6,164,118 | A | 12/2000 | Suzuki et al. | |
| 6,200,441 | B1 | 3/2001 | Gornicki et al. | |
| 6,204,995 | B1 | 3/2001 | Hokkyo et al. | |
| 6,206,765 | B1 | 3/2001 | Sanders et al. | |
| 6,210,819 | B1 | 4/2001 | Lal et al. | |
| 6,216,709 | B1 | 4/2001 | Fung et al. | |
| 6,221,119 | B1 | 4/2001 | Homola | |
| 6,248,395 | B1 | 6/2001 | Homola et al. | |
| 6,261,681 | B1 | 7/2001 | Suekane et al. | |
| 6,270,885 | B1 | 8/2001 | Hokkyo et al. | |
| 6,274,063 | B1 | 8/2001 | Li et al. | |
| 6,283,838 | B1 | 9/2001 | Blake et al. | |
| 6,287,429 | B1 | 9/2001 | Moroishi et al. | |
| 6,290,573 | B1 | 9/2001 | Suzuki | |
| 6,299,947 | B1 | 10/2001 | Suzuki et al. | |
| 6,303,217 | B1 | 10/2001 | Malhotra et al. | |
| 6,309,765 | B1 | 10/2001 | Suekane et al. | |
| 6,358,636 | B1 | 3/2002 | Yang et al. | |
| 6,358,912 | B1 * | 3/2002 | Evers et al. | 510/505 |
| 6,362,452 | B1 | 3/2002 | Suzuki et al. | |
| 6,363,599 | B1 | 4/2002 | Bajorek | |
| 6,365,012 | B1 | 4/2002 | Sato et al. | |
| 6,381,090 | B1 | 4/2002 | Suzuki et al. | |
| 6,381,092 | B1 | 4/2002 | Suzuki | |
| 6,387,483 | B1 | 5/2002 | Hokkyo et al. | |
| 6,391,213 | B1 | 5/2002 | Homola | |
| 6,395,349 | B1 | 5/2002 | Salamon | |
| 6,403,919 | B1 | 6/2002 | Salamon | |
| 6,408,677 | B1 | 6/2002 | Suzuki | |
| 6,426,157 | B1 | 7/2002 | Hokkyo et al. | |
| 6,429,984 | B1 | 8/2002 | Alex | |
| 6,462,014 | B1 * | 10/2002 | Johnson et al. | 510/504 |
| 6,482,330 | B1 | 11/2002 | Bajorek | |
| 6,482,505 | B1 | 11/2002 | Bertero et al. | |
| 6,500,567 | B1 | 12/2002 | Bertero et al. | |
| 6,525,009 | B2 | 2/2003 | Sachdev et al. | |
| 6,528,124 | B1 | 3/2003 | Nguyen | |
| 6,548,821 | B1 | 4/2003 | Treves et al. | |
| 6,552,871 | B2 | 4/2003 | Suzuki et al. | |
| 6,565,719 | B1 | 5/2003 | Lairson et al. | |
| 6,566,674 | B1 | 5/2003 | Treves et al. | |
| 6,571,806 | B2 | 6/2003 | Rosano et al. | |
| 6,585,817 | B2 * | 7/2003 | Lee et al. | 106/31.58 |
| 6,628,466 | B2 | 9/2003 | Alex | |
| 6,664,503 | B1 | 12/2003 | Hsieh et al. | |
| 6,670,055 | B2 | 12/2003 | Tomiyasu et al. | |
| 6,682,807 | B2 | 1/2004 | Lairson et al. | |

(Continued)

FOREIGN PATENT DOCUMENTS

EP 1260575 A1 * 11/2002

OTHER PUBLICATIONS

Soh Kian Koo, et al., U.S. Appl. No. 13/433,037, filed Mar. 28, 2012, 14 pages.
EE Boon Quah, et al., U.S. Appl. No. 12/841,121, filed, 16 pages.

*Primary Examiner* — Nicole M Buie-Hatcher
*Assistant Examiner* — M. Reza Asdjodi
(74) *Attorney, Agent, or Firm* — Loza & Loza, LLP; Michael F. Fedrick; Gabriel Fitch

(57) ABSTRACT

A detergent composition comprising ethylene oxide/propyleneoxide (EO/PO), sodium-2-ethylhexyliminodipropionate, potassium hydroxide, hydroxyethylene diphosphonic acid (HEDP), and diethylenetriamine-penta(methylene phosphonic acid) (DTPMP) for removing contaminants from the surface of a hard disk.

19 Claims, 4 Drawing Sheets

(56) References Cited

U.S. PATENT DOCUMENTS 6,683,754 B2 1/2004 Suzuki et al.
6,730,420 B1 5/2004 Bertero et al.
6,743,528 B2 6/2004 Suekane et al.
6,759,138 B2 7/2004 Tomiyasu et al.
6,778,353 B1 8/2004 Harper
6,795,274 B1 9/2004 Hsieh et al.
6,855,232 B2 2/2005 Jairson et al.
6,857,937 B2 2/2005 Bajorek
6,869,923 B1 * 3/2005 Cunningham et al. ..... 512/4
6,893,748 B2 5/2005 Bertero et al.
6,899,959 B2 5/2005 Bertero et al.
6,916,558 B2 7/2005 Umezawa et al.
6,939,120 B1 9/2005 Harper
6,946,191 B2 9/2005 Morikawa et al.
6,967,798 B2 11/2005 Homola et al.
6,972,135 B2 12/2005 Homola
7,004,827 B1 2/2006 Suzuki et al.
7,006,323 B1 2/2006 Suzuki
7,016,154 B2 3/2006 Nishihira
7,019,924 B2 3/2006 McNeil et al.
7,045,215 B2 5/2006 Shimokawa
7,070,870 B2 7/2006 Bertero et al.
7,090,934 B2 8/2006 Hokkyo et al.
7,099,112 B1 8/2006 Harper
7,105,241 B2 9/2006 Shimokawa et al.
7,119,990 B2 10/2006 Bajorek et al.
7,147,790 B2 12/2006 Wachenschwanz et al.
7,161,753 B2 1/2007 Wachenschwanz et al.
7,166,319 B2 1/2007 Ishiyama
7,166,374 B2 1/2007 Suekane et al.
7,169,487 B2 1/2007 Kawai et al.
7,174,775 B2 2/2007 Ishiyama
7,179,549 B2 2/2007 Malhotra et al.
7,184,139 B2 2/2007 Treves et al.
7,196,860 B2 3/2007 Alex
7,199,977 B2 4/2007 Suzuki et al.
7,208,236 B2 4/2007 Morikawa et al.
7,220,500 B1 5/2007 Tomiyasu et al.
7,229,266 B2 6/2007 Harper
7,239,970 B2 7/2007 Treves et al.
7,252,897 B2 8/2007 Shimokawa et al.
7,277,254 B2 10/2007 Shimokawa et al.
7,281,920 B2 10/2007 Homola et al.
7,292,329 B2 11/2007 Treves et al.
7,301,726 B1 11/2007 Suzuki
7,302,148 B2 11/2007 Treves et al.
7,305,119 B2 12/2007 Treves et al.
7,314,404 B2 1/2008 Singh et al.
7,320,584 B1 1/2008 Harper et al.
7,329,114 B2 2/2008 Harper et al.
7,375,362 B2 5/2008 Treves et al.
7,420,886 B2 9/2008 Tomiyasu et al.
7,425,719 B2 9/2008 Treves et al.
7,471,484 B2 12/2008 Wachenschwanz et al.
7,498,062 B2 3/2009 Calcaterra et al.
7,531,485 B2 5/2009 Hara et al.
7,537,846 B2 5/2009 Ishiyama et al.
7,549,209 B2 6/2009 Wachenschwanz et al.
7,569,490 B2 8/2009 Staud
7,597,792 B2 10/2009 Homola et al.
7,597,973 B2 10/2009 Ishiyama
7,608,193 B2 10/2009 Wachenschwanz et al.
7,632,087 B2 12/2009 Homola
7,656,615 B2 2/2010 Wachenschwanz et al.
7,682,546 B2 3/2010 Harper
7,684,152 B2 3/2010 Suzuki et al.
7,686,606 B2 3/2010 Harper et al.
7,686,991 B2 3/2010 Harper
7,695,833 B2 4/2010 Ishiyama
7,722,968 B2 5/2010 Ishiyama
7,733,605 B2 6/2010 Suzuki et al.
7,736,768 B2 6/2010 Ishiyama
7,755,861 B1 7/2010 Li et al.
7,758,732 B1 7/2010 Calcaterra et al.
7,833,639 B2 11/2010 Sonobe et al.
7,833,641 B2 11/2010 Tomiyasu et al.
7,838,485 B2 * 11/2010 Heisig et al. ..... 510/422
7,910,159 B2 3/2011 Jung
7,911,736 B2 3/2011 Bajorek
7,924,519 B2 4/2011 Lambert
7,944,165 B1 5/2011 O'Dell
7,944,643 B1 5/2011 Jiang et al.
7,955,723 B2 6/2011 Umezawa et al.
7,983,003 B2 7/2011 Sonobe et al.
7,993,497 B2 8/2011 Moroishi et al.
7,993,765 B2 8/2011 Kim et al.
7,998,912 B2 8/2011 Chen et al.
8,002,901 B1 8/2011 Chen et al.
8,003,237 B2 8/2011 Sonobe et al.
8,012,920 B2 9/2011 Shimokawa
8,038,863 B2 10/2011 Homola
8,057,926 B2 11/2011 Ayama et al.
8,062,778 B2 11/2011 Suzuki et al.
8,064,156 B1 11/2011 Suzuki et al.
8,076,013 B2 12/2011 Sonobe et al.
8,092,931 B2 1/2012 Ishiyama et al.
8,100,685 B1 1/2012 Harper et al.
8,101,054 B2 1/2012 Chen et al.
8,125,723 B1 2/2012 Nichols et al.
8,125,724 B1 2/2012 Nichols et al.
8,137,517 B1 3/2012 Bourez
8,142,916 B2 3/2012 Umezawa et al.
8,163,093 B1 4/2012 Chen et al.
8,171,949 B1 5/2012 Lund et al.
8,173,282 B1 5/2012 Sun et al.
8,178,480 B2 5/2012 Hamakubo et al.
8,206,789 B2 6/2012 Suzuki
8,218,260 B2 7/2012 Iamratanakul et al.
8,227,398 B2 7/2012 Kany et al.
8,247,095 B2 8/2012 Champion et al.
8,257,783 B2 9/2012 Suzuki et al.
8,298,609 B1 10/2012 Liew et al.
8,298,689 B2 10/2012 Sonobe et al.
8,309,239 B2 11/2012 Umezawa et al.
8,316,668 B1 11/2012 Chan et al.
8,331,056 B2 12/2012 O'Dell
8,354,618 B1 1/2013 Chen et al.
8,367,228 B2 2/2013 Sonobe et al.
8,383,209 B2 2/2013 Ayama
8,394,243 B1 3/2013 Jung et al.
8,397,751 B1 3/2013 Chan et al.
8,399,809 B1 3/2013 Bourez
8,402,638 B1 3/2013 Treves et al.
8,404,056 B1 3/2013 Chen et al.
8,404,369 B2 3/2013 Ruffini et al.
8,404,370 B2 3/2013 Sato et al.
8,406,918 B2 3/2013 Tan et al.
8,414,966 B2 4/2013 Yasumori et al.
8,425,975 B2 4/2013 Ishiyama
8,431,257 B2 4/2013 Kim et al.
8,431,258 B2 4/2013 Onoue et al.
8,453,315 B2 6/2013 Kajiwara et al.
8,488,276 B1 7/2013 Jung et al.
8,491,800 B1 7/2013 Dorsey
8,492,009 B1 7/2013 Homola et al.
8,492,011 B2 7/2013 Itoh et al.
8,496,466 B1 7/2013 Treves et al.
8,517,364 B1 8/2013 Crumley et al.
8,517,657 B2 8/2013 Chen et al.
8,524,052 B1 9/2013 Tan et al.
8,530,065 B1 9/2013 Chernyshov et al.
8,546,000 B2 10/2013 Umezawa
8,551,253 B2 10/2013 Na'im et al.
8,551,627 B2 10/2013 Shimada et al.
8,556,566 B1 10/2013 Suzuki et al.
8,559,131 B2 10/2013 Masuda et al.
8,562,748 B1 10/2013 Chen et al.
8,565,050 B1 10/2013 Bertero et al.
8,570,844 B1 10/2013 Yuan et al.
8,580,410 B2 11/2013 Onoue
8,584,687 B1 11/2013 Chen et al.
8,591,709 B1 11/2013 Lim et al.
8,592,061 B2 11/2013 Onoue et al.
8,596,287 B1 12/2013 Chen et al.

(56) References Cited

U.S. PATENT DOCUMENTS 8,597,723 B1 12/2013 Jung et al.
8,603,649 B2 12/2013 Onoue
8,603,650 B2 12/2013 Sonobe et al.
8,605,388 B2 12/2013 Yasumori et al.
8,605,555 B1 12/2013 Chernyshov et al.
8,608,147 B1 12/2013 Yap et al.
8,609,263 B1 12/2013 Chernyshov et al.
8,619,381 B2 12/2013 Moser et al.
8,623,528 B2 1/2014 Umezawa et al.
8,623,529 B2 1/2014 Suzuki
8,634,155 B2 1/2014 Yasumori et al.
8,658,003 B1 2/2014 Bourez
8,658,292 B1 2/2014 Mallary et al.
8,665,541 B2 3/2014 Saito
8,668,953 B1 3/2014 Buechel-Rimmel
8,674,327 B1 3/2014 Poon et al.
8,685,214 B1 4/2014 Moh et al.
8,696,404 B2 4/2014 Sun et al.
8,711,499 B1 4/2014 Desai et al.
8,743,666 B1 6/2014 Bertero et al.
8,758,912 B2 6/2014 Srinivasan et al.
8,787,124 B1 7/2014 Chernyshov et al.
8,787,130 B1 7/2014 Yuan et al.
8,791,391 B2 7/2014 Bourez
8,795,765 B2 8/2014 Koike et al.
8,795,790 B2 8/2014 Sonobe et al.
8,795,857 B2 8/2014 Ayama et al.
8,800,322 B1 8/2014 Chan et al.
8,811,129 B1 8/2014 Yuan et al.
8,817,410 B1 8/2014 Moser et al.
9,029,308 B1 * 5/2015 Koo et al. ..... 510/175
2002/0060883 A1 5/2002 Suzuki
2003/0022024 A1 1/2003 Wachenschwanz
2003/0144163 A1 7/2003 Morinaga et al.
2003/0166492 A1 * 9/2003 Holderbaum et al. ..... 510/445
2003/0166493 A1 * 9/2003 Holderbaum et al. ..... 510/445
2004/0022387 A1 2/2004 Weikle
2004/0132301 A1 7/2004 Harper et al.
2004/0202793 A1 10/2004 Harper et al.
2004/0202865 A1 10/2004 Homola et al.
2004/0209123 A1 10/2004 Bajorek et al.
2004/0209470 A1 10/2004 Bajorek
2005/0036223 A1 2/2005 Wachenschwanz et al.
2005/0142990 A1 6/2005 Homola
2005/0150862 A1 7/2005 Harper et al.
2005/0151282 A1 7/2005 Harper et al.
2005/0151283 A1 7/2005 Bajorek et al.
2005/0151300 A1 7/2005 Harper et al.
2005/0155554 A1 7/2005 Saito
2005/0167867 A1 8/2005 Bajorek et al.
2005/0263401 A1 12/2005 Olsen et al.
2006/0113506 A1 * 6/2006 Man et al. ..... 252/186.1
2006/0147758 A1 7/2006 Jung et al.
2006/0166853 A1 * 7/2006 Feyt ..... 510/470
2006/0181697 A1 8/2006 Treves et al.
2006/0194708 A1 * 8/2006 Barthel et al. ..... 510/337
2006/0207890 A1 9/2006 Staud
2006/0217280 A1 9/2006 Scheper et al.
2007/0036832 A1 * 2/2007 Williams et al. ..... 424/405
2007/0070549 A1 3/2007 Suzuki et al.
2007/0245909 A1 10/2007 Homola
2007/0275231 A1 * 11/2007 Meyer et al. ..... 428/325
2008/0020239 A1 1/2008 Osawa
2008/0075845 A1 3/2008 Sonobe et al.
2008/0093760 A1 4/2008 Harper et al.
2008/0221006 A1 * 9/2008 Heisig et al. ..... 510/272
2008/0251106 A1 * 10/2008 Scialla et al. ..... 134/42
2009/0029895 A1 * 1/2009 Scialla et al. ..... 510/180
2009/0117408 A1 5/2009 Umezawa et al.
2009/0136784 A1 5/2009 Suzuki et al.
2009/0149364 A1 6/2009 Beck
2009/0169922 A1 7/2009 Ishiyama
2009/0191331 A1 7/2009 Umezawa et al.
2009/0202866 A1 8/2009 Kim et al.
2009/0311557 A1 12/2009 Onoue et al.
2009/0312219 A1 12/2009 Tamura et al.
2010/0143752 A1 6/2010 Ishibashi et al.
2010/0190035 A1 7/2010 Sonobe et al.
2010/0196619 A1 8/2010 Ishiyama
2010/0196740 A1 8/2010 Ayama et al.
2010/0209601 A1 8/2010 Shimokawa et al.
2010/0215992 A1 8/2010 Horikawa et al.
2010/0221417 A1 9/2010 Miyamoto et al.
2010/0232065 A1 9/2010 Suzuki et al.
2010/0247965 A1 9/2010 Onoue
2010/0261039 A1 10/2010 Itoh et al.
2010/0279151 A1 11/2010 Sakamoto et al.
2010/0300884 A1 12/2010 Homola et al.
2010/0304186 A1 12/2010 Shimokawa
2011/0097603 A1 4/2011 Onoue
2011/0097604 A1 4/2011 Onoue
2011/0151752 A1 6/2011 Ono et al.
2011/0171495 A1 7/2011 Tachibana et al.
2011/0206947 A1 8/2011 Tachibana et al.
2011/0212346 A1 9/2011 Onoue et al.
2011/0223446 A1 9/2011 Onoue et al.
2011/0244119 A1 10/2011 Umezawa et al.
2011/0299194 A1 12/2011 Aniya et al.
2011/0311841 A1 12/2011 Saito et al.
2012/0069466 A1 3/2012 Okamoto et al.
2012/0070692 A1 3/2012 Sato et al.
2012/0077060 A1 3/2012 Ozawa
2012/0127599 A1 5/2012 Shimokawa et al.
2012/0127601 A1 5/2012 Suzuki et al.
2012/0129009 A1 5/2012 Sato et al.
2012/0140359 A1 6/2012 Tachibana
2012/0141833 A1 6/2012 Umezawa et al.
2012/0141835 A1 6/2012 Sakamoto
2012/0148875 A1 6/2012 Hamakubo et al.
2012/0156523 A1 6/2012 Seki et al.
2012/0164488 A1 6/2012 Shin et al.
2012/0170152 A1 7/2012 Sonobe et al.
2012/0171369 A1 7/2012 Koike et al.
2012/0175243 A1 7/2012 Fukuura et al.
2012/0189872 A1 7/2012 Umezawa et al.
2012/0196049 A1 8/2012 Azuma et al.
2012/0207919 A1 8/2012 Sakamoto et al.
2012/0225217 A1 9/2012 Itoh et al.
2012/0251842 A1 10/2012 Yuan et al.
2012/0251846 A1 10/2012 Desai et al.
2012/0276417 A1 11/2012 Shimokawa et al.
2012/0308722 A1 12/2012 Suzuki et al.
2013/0040167 A1 2/2013 Alagarsamy et al.
2013/0071694 A1 3/2013 Srinivasan et al.
2013/0165029 A1 6/2013 Sun et al.
2013/0175252 A1 7/2013 Bourez
2013/0216865 A1 8/2013 Yasumori et al.
2013/0230647 A1 9/2013 Onoue et al.
2013/0314815 A1 11/2013 Yuan et al.
2014/0011054 A1 1/2014 Suzuki
2014/0044992 A1 2/2014 Onoue
2014/0050843 A1 2/2014 Yi et al.
2014/0151360 A1 6/2014 Gregory et al.
2014/0234666 A1 8/2014 Knigge et al.

* cited by examiner

DETERGENT COMPOSITION WITH LOW FOAM AND HIGH NICKEL SOLUBILITY

CROSS-REFERENCE TO RELATED APPLICATION

This application claims priority to and incorporate by reference the provisional U.S. Patent Application Ser. No. 61/941,295, entitled "Detergent Solution For Nickel Removal With Low Foam and High Nickel Solubility," filed on Feb. 18, 2014.

BACKGROUND

Hard disk drives generally incorporate stacked, commonly rotated rigid magnetic disks which are used for storage of data in magnetic form on the disk surfaces. The data is recorded in concentric, radially spaced data information tracks arrayed on the surfaces of the disks. Transducer heads are driven in a path toward and away from the drive axis in order to write data to the disks and read data from them.

The hard disks used in hard drives can comprise a substrate plated, for example, with nickel and phosphorus. Subsequent to plating, the disks are usually polished using chemical mechanical polishing, which exposes the disk to contaminants from the polish slurry, polish residue, manufacturing equipment, and/or the manufacturing environment. Nickel and phosphorus in the polishing slurry and/or derived from the surface of the disk, for instance, may bond back to the disk surface.

Contaminating particles on the surface of a hard disk, in particular nickel oxide (NiO) and nickel phosphorous (NiP) particles, can cause thermal asperities, i.e. local heating of the disk during operation due to the mechanical collision of the drive head with such particles protruding on the disk surface. If contaminating particles are not removed from the plated and polished disk, the operation and performance of a hard drive incorporating the disk may be negatively impacted, for instance due to head crash.

FIGURES

DESCRIPTION

Figure 1:
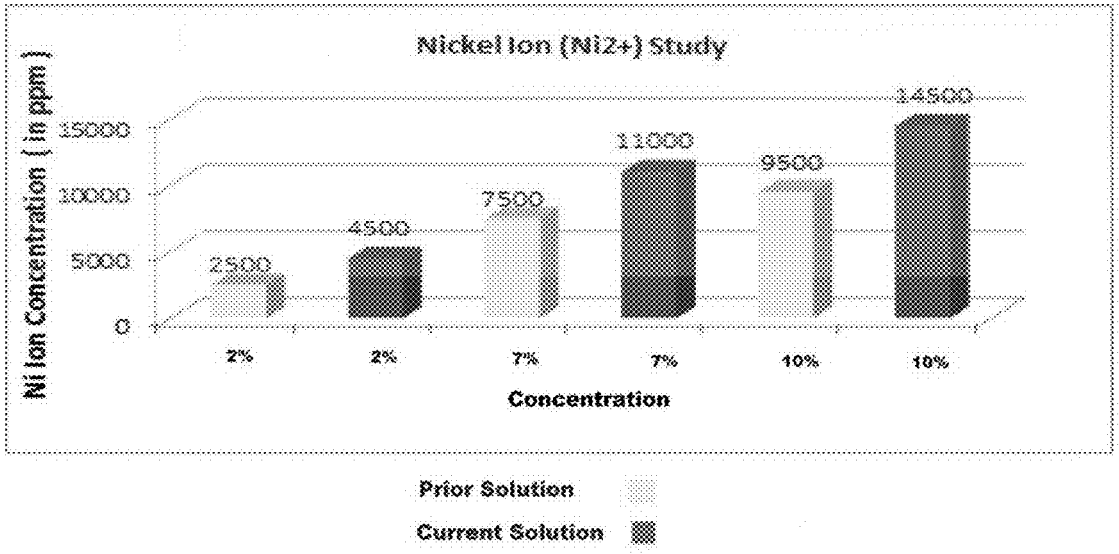
FIG. 1 is a graph showing the results of a test of the solubility of nickel in different concentrations of detergent solutions.

As used herein, the following terms and variations thereof have the meanings given below, unless a different meaning is clearly intended by the context in which such term is used.

"Cleaning" refers to the removal of unwanted materials. In regard to the surface of a hard disk drive, unwanted materials include particulates and other materials that would interfere with the proper or optimal operation of a hard disk drive.

"Contaminant" refers to an unwanted material as described above.

"Detergent" refers to a composition that combines with or chemically interacts with one or more contaminants of a material being cleaned in order to make the contaminants more soluble or otherwise to remove them from the material.

"Hard disk" refers to a rigid disk comprising a magnetic material used for storing computer data.

"Hard disk drive" and "disk drive" refer to a component of a computer or other system for storing data on a rotating hard disk fixed within the hard disk drive.

"Solution" refers to a homogeneous mixture of two or more substances. An "aqueous solution" is a solution in which one of the substances is water, and in which water is generally the solvent, i.e. the substance present in the greatest amount.

The term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Detergent Composition

There remains a need for improved detergent compositions for removing contaminants from the surfaces of hard disks, in particular disks plated or coated with nickel and/or phosphorous. The present detergent composition includes a combination of nonionic and amphoteric surfactants, chelating agents, and other formulation components which provide improved nickel removal from disk surfaces compared with prior detergents.

The surfactants of the present detergent preferably include an amphoteric surfactant, in particular sodium-2-ethylhexylimino dipropionate, which provides less foaming than other nonionic surfactants conventionally used to remove contaminants from hard disk surfaces. Ethylene oxide/propyleneoxide (EO/PO), a primary alcohol alkoxylate and nonionic surfactant, is also preferably used to provide hard surface cleaning with relatively low foaming. The detergent's foaming characteristics determine the degree of bubbles trapped in a cleaning tank. A higher bubble level causes more problems due to particles being trapped on container surfaces, and bubbles prevent particles from draining for filtration. The presence of fewer bubbles thus reduces contaminants and hence disk media defects.

The chelating agents used in the present detergent formulation preferably include diethylenetriamine penta (methylene phosphonic acid) (DTPMP), which provides high nickel solubility during disk cleaning due to its ability to form a complex bond with up to eight nickel ions, thereby allowing Ni ions to remain in solution and be rinsed away from the disk surface. The chelating agent hydroxyethylene diphosphonic acid (HEDP) is also preferably used in the present formulation.

The foregoing formulation components are preferably formulated in deionized water, preferably also together with potassium hydroxide (KOH), an inorganic salt, and oxalic acid, a reducing agent. The present detergent composition for removing contaminants from a hard disk surface thus preferably comprises ethylene oxide/propyleneoxide (EO/PO), sodium-2-ethylhexyliminodipropionate, potassium hydroxide (KOH), hydroxyethylene diphosphonic acid (HEDP), diethylenetriamine-penta(methylene phosphonic acid) (DTPMP), and oxalic acid.

In a preferred embodiment, the present detergent composition comprises the foregoing components in the following percentages by weight, in the absence of water or other solvent:

1%-5% ethylene oxide/propyleneoxide (EO/PO);
10%-15% sodium-2-ethylhexyliminodipropionate;
25%-30% potassium hydroxide (KOH);

20%-25% hydroxyethylene diphosphonic acid (HEDP);

30%-35% diethylenetriamine-penta(methylene phosphonic acid) (DTPMP); and

1%-5% oxalic acid.

The present detergent composition is preferably used as an aqueous solution when cleaning hard disk surfaces, and can be formulated as a concentrated solution prior to use as a cleaning agent. When applied to the surface of a hard disk, the detergent composition is preferably a solution diluted so that the detergent components, not including water, comprise between 1% and 10% of the solution, such as a solution comprising between 3% and 5% of the detergent components. Such a solution can thus comprise between 0.01% and 3.5% by weight of each of the following components: EO/PO, sodium-2-ethylhexyliminodipropionate, KOH, HEDP, DTPMP, and oxalic acid. More particularly, the solution can comprise, by weight:

0.01%-0.5% ethylene oxide/propyleneoxide (EO/PO);

0.1%-1.5% sodium-2-ethylhexyliminodipropionate;

0.25%-3.0% potassium hydroxide (KOH);

0.20%-2.5% hydroxyethylene diphosphonic acid (HEDP);

0.3%-3.5% diethylenetriamine-penta(methylene phosphonic acid) (DTPMP); and 0.01%-0.5% oxalic acid.

The foregoing solution preferably has a pH of between 11.3 and 12.3, such as a pH of 11.8, and a cloud point of >60° C. The surface tension of the solution is advantageously between 32.7 mN/m and 42.7 mN/m, for example about 37 mN/m.

Table 1 below summarizes preferred detergent compositions of the present invention.

TABLE 1

Detergent Compositions

| Component | Amount* (without water) | Amount* (10% dilution) | Amount* (1% dilution) |
|---|---|---|---|
| Ethylene oxide/propyleneoxide (EO/PO) | 1-5 | 0.1-0.5 | 0.01-0.05 |
| Sodium-2-ethylhexyliminodipropionate | 10-15 | 1.0-1.5 | 0.1-0.15 |
| Potassium hydroxide (KOH) | 25-30 | 2.5-3.0 | 0.25-0.30 |
| Hydroxyethylene diphosphonic acid (HEDP) | 20-25 | 2.0-2.5 | 0.2-0.25 |
| DTPMP Diethylenetriamine-penta(methylene phosphonic acid) | 30-35 | 3.0-3.5 | 0.3-0.35 |
| Oxalic acid | 1-5 | 0.1-0.5 | 0.01-0.05 |
| Deionized (DI) water | 0 | (Balance) | (Balance) |

*Amounts denote weight as a percent of the weight of the listed composition.

The present detergent can also be formulated as a more concentrated solution, either for direct application as a detergent or for further dilution to form a final solution, such as one of the solutions described above. Table 2 below describes the components of illustrative embodiments of such concentrated solutions.

TABLE 2

Concentrated Detergent Solutions

| Component | Amount* | Amount* |
|---|---|---|
| Ethylene oxide/propyleneoxide | 0.5-5.0 | 1-5 |
| Sodium-2-ethylhexyliminodipropionate | 3.0-5.0 | 1-5 |

TABLE 2-continued

Concentrated Detergent Solutions

| Component | Amount* | Amount* |
|---|---|---|
| Potassium hydroxide (KOH) | 4.0-7.0 | 2-6 |
| Hydroxyethylene diphosphonic acid (HEDP) | 3.0-6.0 | 3-10 |
| DTPMP Diethylenetriamine-penta(methylene phosphonic acid) | 7.0-10.0 | 3-10 |
| Oxalic acid | 0.5-1.0 | <1 |
| Deionized (DI) water | (Balance) | (Balance) |

*Amounts denote weight as a percent of the weight of the listed composition.

The properties of an illustrative embodiment of the present detergent composition are shown in Table 3 below.

TABLE 3

Detergent Properties

| Property | Measurement |
|---|---|
| Density | 1.08 g/cm$^3$ |
| pH (3% solution) | 11.84 |
| Surface Tension (3% solution) | 37.7 mN/m |
| Cloud Point (undiluted solution) | >55 |

The present detergent composition is particularly effective at removing contaminants consisting of nickel, aluminum, silicon, oxygen and/or phosphorus, such as nickel oxide (NiO), nickel phosphorous (NiP), silica oxide (SiO), and AlSiO. Such contaminants can be present on the surface of a hard disk, especially when the surface of the hard disk is plated with nickel and/or phosphorous. The present detergent solution has numerous advantages, including:

improved nickel and NiP solubility, minimizing NiP redeposition onto media surfaces;

lower foaming, which reduces stains and contaminants on media substrate surfaces after cleaning, and also helps prevent particles from becoming trapped and accumulating with bubbles on the top of tank surfaces;

good rinsability, to prevent detergent residue on substrates after cleaning;

better SiO removal;

better cleaning of organic and inorganic contaminants;

better chelating, reducing, and/or complexing of nickel;

no precipitation of metal ions which may remain on substrate after cleaning;

relatively low surface tension, improving wetting and cleaning;

good dispersibility (low agglomeration);

low chloride content to avoid corrosion;

thermal stability, i.e. a high cloud point (>60° C.), which prevents foaming of micelle particles; and low nano-asperity.

Detergent Components

Ethylene Oxide/Propyleneoxide (EO/PO).

The EO/PO component of the present detergent is a nonionic surfactant polymer comprising ethylene oxide and/or propyleneoxide. It is preferably a branched ethoxylated linear alcohol containing 8 to 10 carbon atoms and having a propylene oxide cap. An example of such an EO/PO composition is available from Rhodia Inc. (Cranbury, N.J.) as ANTAROX LF-224 (CAS No. 37251-67-5). The EO/PO surfactant can also be a block copolymer, i.e. a polymer comprising two or more homopolymer subunits linked by covalent bonds, with the subunits being ethylene oxide and propyleneoxide, respectively. EO/PO provides hard surface cleaning with controlled foam and good rinsability.

Sodium-2-Ethylhexylimino Dipropionate.

Sodium-2-ethylhexylimino dipropionate is the sodium salt of 2-ethylhexylimino dipropionic acid. It is an amphoteric surfactant, sold for example as AMPHOTENSID EH, available from Zschimmer & Schwarz (Milledgeville, Ga.). Sodium-2-ethylhexylimino dipropionate has the following structure:

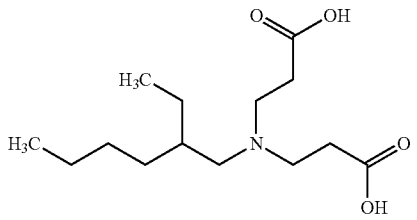

The use of this surfactant in predetermined quantities in the present composition reduces foaming compared with prior detergents used to remove impurities from hard disk surfaces.

Potassium Hydroxide (KOH).

Potassium hydroxide (CAS No. 1310-58-3) is an inorganic salt used in the present detergent solution.

Hydroxyethylene Diphosphonic Acid (HEDP).

HEDP, or (1-hydroxyethan-1,1-diyl)bis(phosphonic acid), acts as a chelating agent. It is also referred to as etidronic acid (CAS No. 2809-21-4) and has the following structure:

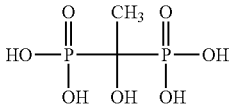

DTPMP.

DTPMP (CAS No. 22042-96-2), or diethylenetriamine penta(methylene phosphonic acid), is a chelating agent which has the following structure:

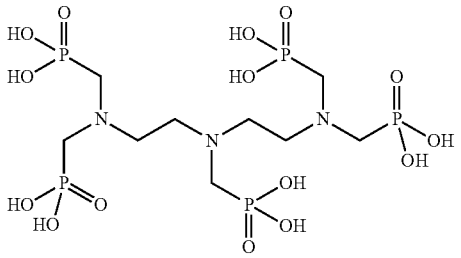

DTPMP is a phosphonate analog of EDTA, and can dissociate into 8 positive-negative ions, giving it the ability to chelate a number of metal ions, such as nickel ions. In addition, DTPMP can inhibit corrosion, in particular NiO formation, by sequestration of metal ions. It also inhibits the precipitation of sparingly soluble salts of alkaline-earth metals during media cleaning.

Oxalic Acid.

Oxalic acid (CAS No. 6153-56-5) is preferably included in the detergent formulation as a reducing agent.

The remainder of the present formulation can be water, preferably deionized (DI) water.

Method of Use

The present detergent compositions are used to clean the outer surface of a hard disk, in particular following a chemical and/or mechanical polishing step, when contaminants such as nickel, aluminum, silicon, oxygen and phosphorus compounds may become adhered, bonded, or otherwise associated with the surface of the disk. The present detergent composition is particularly useful in removing nickel oxide (NiO), nickel phosphorous (NiP), silica oxide (SiO), and AlSiO contaminants.

In order to clean the surface of a hard disk, the present detergent composition is first formed as an aqueous solution, as described above. A hard disk surface which has been exposed to processing conditions that are likely to result in the presence of contaminants on the surface of the hard disk is then contacted with the aqueous detergent solution. The hard disk surface can be placed into contact with the detergent solution in various ways known to the art, such as by dipping the disk into the detergent solution or by spraying the detergent solution onto the disk surface. At least some of the contaminants are thereby removed or dissociated from the surface of the hard disk and are transferred into the detergent solution.

The detergent solution is then removed from the surface of the hard disk by ways known to the art, depending in part on how it was applied to the surface. Following such removal, the surface of the hard disk can be rinsed with deionized water, in order to remove any remaining detergent solution from the surface of the hard disk. The deionized water or other solvent applied to the hard disk surface can then be removed by drying the surface, such as by allowing the solvent to evaporate.

EXAMPLES

Example 1

Solubility

The solubility of nickel in the present detergent formulation was compared with the nickel solubility of a prior formulation for cleaning plated hard disk surfaces. The prior formulation comprised nonionic surfactants, an inorganic salt, chelating agents, a reducing agent, and a dispersing agent ("Formulation 1").

In this test, 1 g of nickel salt was mixed with a 2%, 7% and 10% solution of the present detergent composition in 100 ml. The precipitation of $Ni^{2+}$ was observed. The current formulation was clear with no precipitation, while the prior formulation was turbid with some precipitation. FIG. 1 shows that at the concentrations tested, nickel was more soluble in the present detergent composition.

Example 2

Silica Oxide (SiO) Particle Removal

Figure 2:
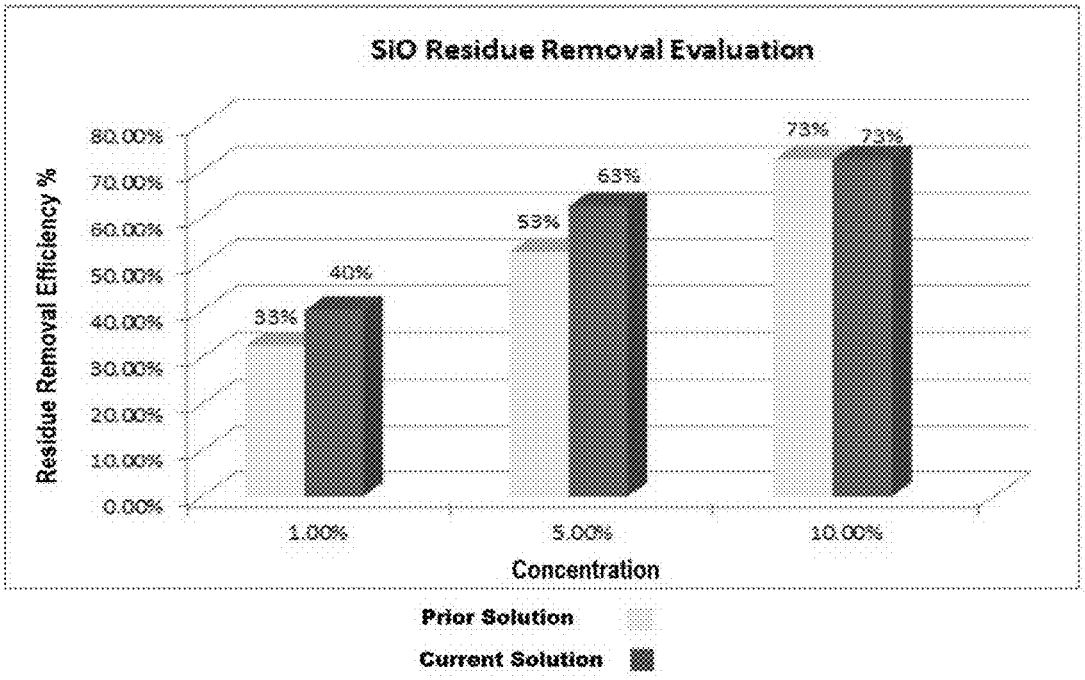
FIG. 2 is a graph showing the results of a test of the ability of detergent solutions to remove SiO.

A test was run with a 10-20 nM SiO slurry, which was allowed to dry for 24 hours on disk surfaces. The surfaces were then cleaned with the prior detergent solution used in Example 1 and a 1%, 5%, and 10% solution of the present detergent composition. After drying, the surfaces were inspected. The results, shown in FIG. 2, demonstrate that the present detergent composition had a better SiO slurry residue removal rate compared to the prior detergent.

Example 3

Aluminum Silicate (AlSiO) Particle Removal

In a further study, a slurry containing AlSiO particles was dispensed in drops onto a NiP substrate surface and dried for 1 hour. The treated substrate was then soaked in a 3% and 5% solution of the present detergent composition for 10 minutes. Following this, the substrates were rinsed with deionized water for 10 seconds and spin dried at 3000 rpm. Substrates treated with the present detergent solutions had fewer AlSiO particles on their surfaces.

Example 4

Foaming Level Test

Figure 3:
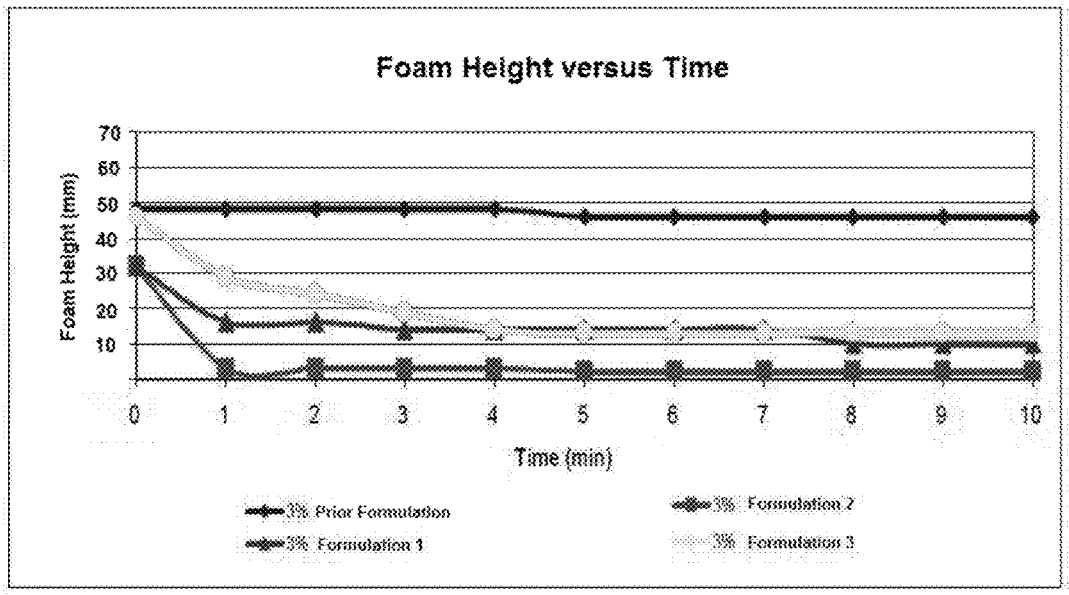
FIG. 3 is a graph showing the results of a test of the foaming characteristics of detergent solutions.

The detergent solutions tested in Examples 1-3 were tested for foaming alongside two additional prior detergent solutions. 30 mL of a 3% solution of each detergent was placed in a 100 mL graduated cylinder and shaken for 20 seconds. The foaming of each solution was then observed after 10 minutes. Results are shown in FIG. 3, where Formulation 1 comprises a solution of the present detergent. The present detergent solution exhibited comparable or better (lower) foaming characteristics compared with the other formulations.

Example 5

Rinsability Test

Figure 4:
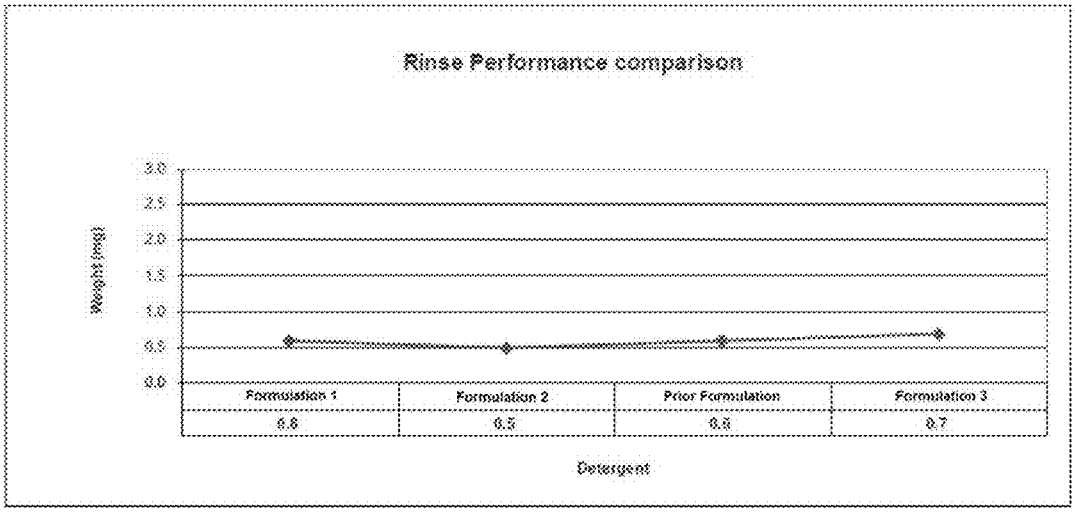
FIG. 4 is a graph showing the results of a test of the rinse characteristics of detergent solutions.

To test rinsability, test substrates were weighed and then soaked in the four detergent solutions of Example 3, undiluted, for 1 minute. The substrates were then individually transferred into a beaker containing deionized water and soaked for 10 seconds (i.e., rinsed). The substrates were then dried at 50° C. for 2-3 hours. After cooling, the substrates were weighed again, and the differences in weight were compared. The present solution had good rinsability, i.e. it did not substantially remain on the substrates, as shown in FIG. 4.

As used herein, the term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Although the present invention has been described in considerable detail with reference to certain preferred embodiments, other embodiments are possible. The steps disclosed for the present methods, for example, are not intended to be limiting nor are they intended to indicate that each step is necessarily essential to the method, but instead are exemplary steps only. Therefore, the scope of the appended claims should not be limited to the description of preferred embodiments contained in this disclosure.

Recitation of value ranges herein is merely intended to serve as a shorthand method for referring individually to each separate value falling within the range. Unless otherwise indicated herein, each individual value is incorporated into the specification as if it were individually recited herein. All references cited herein are incorporated by reference in their entirety.

What is claimed is:

1. A detergent composition for removing contaminants from a surface, wherein in the absence of water the composition comprises the following components by weight:
- 1%-5% ethylene oxide/propyleneoxide (EO/PO);
- 10%-15% sodium-2-ethylhexyliminodipropionate;
- 25%-30% potassium hydroxide (KOH);
- 20%-25% hydroxyethylene diphosphonic acid (HEDP);
- 30%-35% diethylenetriamine-penta(methylene phosphonic acid) (DTPMP); and
- 1%-5% oxalic acid.

2. An aqueous solution comprising water and the detergent composition of claim 1, wherein the aqueous solution comprises between 0.01% and 3.5% by weight of each of the following components: EO/PO, sodium-2-ethylhexyliminodipropionate, KOH, HEDP, DTPMP, and oxalic acid.

3. The aqueous solution of claim 2, comprising by weight:
- 0.01%-0.5% ethylene oxide/propyleneoxide (EO/PO);
- 0.1%-1.5% sodium-2-ethylhexyliminodipropionate;
- 0.25%-3.0% potassium hydroxide (KOH);
- 0.20%-2.5% hydroxyethylene diphosphonic acid (HEDP);
- 0.3%-3.5% diethylenetriamine-penta(methylene phosphonic acid) (DTPMP); and
- 0.01%-0.5% oxalic acid.

4. The aqueous solution of claim 2, wherein the solution has a pH of between 11.3 and 12.3.

5. The aqueous solution of claim 4, wherein the solution has a pH of 11.8.

6. The aqueous solution of claim 2, wherein the solution has a surface tension of between 32.7 mN/m and 42.7 mN/m.

7. The aqueous solution of claim 2, wherein the solution has a surface tension of 37.7 mN/m.

8. The aqueous solution of claim 2, wherein the solution has a cloud point of >60° C.

9. The detergent composition of claim 1, wherein the contaminants comprise elements selected from the group consisting of nickel, aluminum, silicon, oxygen and phosphorus.

10. The detergent composition of claim 9, wherein the contaminants are particles selected from the group consisting of nickel oxide (NiO), nickel phosphorous (NiP), silica oxide (SiO), and AlSiO.

11. The detergent composition of claim 1, wherein the surface is a surface of a hard disk.

12. The aqueous solution of claim 11, wherein the surface of the hard disk is plated with an element selected from the group consisting of nickel and phosphorous.

13. A method of cleaning a surface of a hard disk, comprising the steps of:
- (a) providing the hard disk, wherein the surface of the hard disk comprises contaminants;
- (b) providing an aqueous solution comprising the detergent composition of claim 1;
- (c) contacting the surface of the hard disk with the aqueous solution, wherein at least some of the contaminants are removed from the surface of the hard disk and are transferred into the aqueous solution; and
- (d) removing the aqueous solution from the surface of the hard disk.

14. The method of claim 13, wherein the surface of the hard disk comprises an element selected from the group consisting of nickel and phosphorous.

15. The method of claim 13, wherein the contaminants comprise elements selected from the group consisting of nickel, aluminum, silicon, oxygen and phosphorus.

16. The method of claim 13, wherein the contaminants are particles selected from the group consisting of nickel oxide (NiO), nickel phosphorous (NiP), silica oxide (SiO), and AlSiO.

17. The method of claim 13, wherein the aqueous solution comprises between 0.01% and 3.5% by weight of each of the following: EO/PO, sodium-2-ethylhexyliminodipropionate, KOH, HEDP, DTPMP, and oxalic acid.

18. The method of claim 13, wherein the step of contacting the surface of the hard disk with the aqueous solution is accomplished by dipping the platter into the aqueous solution or by spraying the platter with the aqueous solution.

19. The method of claim 13, further comprising the step of rinsing the hard disk with deionized water after removing the aqueous solution from the surface of the hard disk.

* * * * *